US006089945A

United States Patent [19]

Van Dan Elzen

[11] Patent Number: 6,089,945

[45] Date of Patent: Jul. 18, 2000

[54] YO-YO HAVING A MULTI-IMAGE LENTICULAR INSTRUCTION SYSTEM

[75] Inventor: Thomas J. Van Dan Elzen, Tucson, Ariz.

[73] Assignee: Playmaxx, Inc., Tucson, Ariz.

[21] Appl. No.: 09/225,139

[22] Filed: Jan. 4, 1999

[51] Int. Cl.[7] ..... A63H 1/30; A63H 1/22; G03B 25/02

[52] U.S. Cl. ..... 446/250; 446/245; 446/248; 446/244; 446/243; 40/454

[58] Field of Search ..... 446/243, 244, 446/245, 247, 248, 250, 219; 40/454

[56] References Cited

U.S. PATENT DOCUMENTS 3,268,238 8/1966 Finkel .
3,692,307 9/1972 Henry ..... 273/29
3,805,443 4/1974 Duncan, Jr. .
3,895,457 7/1975 Koskiewicz ..... 446/250
5,451,181 9/1995 Denoux ..... 446/465
5,724,758 3/1998 Gulick, Jr. ..... 40/454
5,769,686 6/1998 Duncan et al. ..... 446/250

*Primary Examiner*—Robert A. Hafer
*Attorney, Agent, or Firm*—Franklin Gobernick

[57] ABSTRACT

A yo-yo having a multi-image lenticular instruction system. The system is incorporated into at least one of the yo-yo's side members via a side cap that is secured to the side member and is readily visible. The instruction system functions by displaying sequential images showing how to perform a predetermined yo-yo trick. A user can manually manipulate the yo-yo to display the images in either a forward or reverse order and at any speed the user desires. By watching the images, the user can easily see how to perform the displayed yo-yo trick.

7 Claims, 8 Drawing Sheets

YO-YO HAVING A MULTI-IMAGE LENTICULAR INSTRUCTION SYSTEM

FIELD OF THE INVENTION

The invention is in the field of user-manipulated toys. More particularly, the invention is an apparatus in the form of a yo-yo that includes an instruction system built into one or both of the yo-yo's side caps. The instruction system makes use of a lenticular display to enable a user to look at the side cap and view an animated series of images that provide instruction for performing a yo-yo trick.

BACKGROUND OF THE INVENTION

Most yo-yos are in the form of two disk-shaped side members that are rigidly connected to each other via a wooden and/or metal axle structure. A center portion of the axle structure acts as an anchor for one end of a string-type tether. The other end of the tether includes a loop designed to be placed about one of a user's fingers to thereby secure the yo-yo to the user. When the tether is wound about the center portion of the axle structure and the yo-yo is released/thrown from the user's hand, the yo-yo will begin to rapidly spin as the tether unwinds. Once the tether is fully unwound, the yo-yo may "sleep" at the end of the tether, whereby the yo-yo continues to spin without having the tether rewind on the axle structure. The majority of yo-yo tricks include steps in which a user manipulates the yo-yo when it is sleeping.

In many prior art yo-yos, the outwardly-facing side of each side member includes a side cap. The exterior surface of the side cap will typically feature lettering, such as a product name, and/or will feature an attractive pattern or color. The side cap functions to increase the aesthetic appeal of the yo-yo, as well as to cover the central, outward-facing area of the associated side member. Additionally, one or both of the yo-yo's side caps may further function to retain, within the associated side member, portions of the fastening structure that connects together the yo-yo's side members.

While a yo-yo is considered by most people to be a simple toy, many tricks that one can do with a yo-yo require the mastering of a number of sometimes complex steps/manipulations of the yo-yo. Some tricks, such as "walk the dog," or "man on the flying trapeze, " require only a few simple steps. More complicated tricks, such as "split the atom," require a large number of steps to accomplish the trick. For many users of yo-yos, learning how to do yo-yo tricks is problematic.

There are many different methods that a user of a yo-yo can employ to learn how to perform yo-yo tricks. Probably the best method is for the user to learn the trick, in person, from someone who can already perform the trick. However, this requires that the experienced person have the time available for teaching, as well as being available at the time the user wishes to learn the trick.

Another common method for learning a yo-yo trick is by watching the trick being performed on a detailed instructional video tape. The user can watch the video and then try to master each of the steps required to perform the trick. An advantage provided when using a video cassette player is that the user can control the display of the trick. Most video players allow the user to replay the trick multiple times, freeze action, display the trick in slow motion, and even to display the trick in reverse sequence. A major problem with this method is that it requires the use of expensive electronic equipment in order to view the video performance of a yo-yo trick. Additionally, the needed equipment is usually not easily portable, and the user may not have the equipment available when he or she wishes to learn how to do a certain trick. Furthermore, a typical instruction video for yo-yo tricks will often teach a large number of tricks, and it may be time consuming for a user to find a particular trick on the video.

Another common method used for learning yo-yo tricks is to read an instructional book or pamphlet in which the trick is described. A series of diagrams or simplified pictures will typically accompany the written description of the trick. This has the advantage of being low in cost and easily portable. However, it is much harder to learn a trick if one cannot watch the trick being performed by a person. Additionally, this method requires that the book or pamphlet be available at the time the user wishes to learn the particular trick. For most users of yo-yos, the yo-yo will be continually carried, while instructional materials will often be left at home.

SUMMARY OF THE INVENTION

The invention is a yo-yo that includes a built-in instruction system for teaching a user how to perform one or more yo-yo tricks. The system is incorporated into at least one of the yo-yo's side caps and features a lenticular display having a base, a plurality of image strips printed on said base, and a lenticular lens atop said strips. Through proper manipulation of the yo-yo, the display can provide the user with a sequence of images that illustrate the major steps required to accomplish a yo-yo trick. While it is known to employ a lenticular imaging system in a yo-yo, as previously done by the DUNCAN YO-YO Company when it offered a yo-yo in which one could orient the yo-yo to cause either SUPERMAN or CLARK KENT to be displayed by the yo-yo's side cap, a lenticular structure in a yo-yo for teaching a user how to perform a yo-yo trick has never before been provided.

The lenticular instruction system of the invention can be accessed whenever the user is holding the yo-yo. The system requires no additional equipment or instructional material. When the yo-yo is oriented to the light in a first position, a first image is displayed showing an initial or first step of doing a particular, predetermined yo-yo trick. The user can then reorient the yo-yo to cause the side cap to display different images that show successive steps for performing the yo-yo trick. By watching these images, much in the same way as a user would watch an instructional video, the user can learn all of the steps necessary for performing the trick.

When a user is learning a trick, it is sometimes helpful to view different portions or steps of the trick either repeatedly, in forward or reverse sequence and/or in stop-action where the action is temporarily frozen. The lenticular instruction system enables such use. This manner of displaying the steps of a yo-yo trick would be extremely difficult, if not impossible, for a live demonstrator of the trick to accomplish. While this type of viewing of images is possible with an instructional video, manipulating the video may be difficult and requires much more effort than would be required through the use of the invention. Compared to images in a book, the lenticular display of images is easier to emulate since they provide an animated progression of images of a person performing the trick.

DETAILED DESCRIPTION OF THE DRAWINGS

Figure 1:
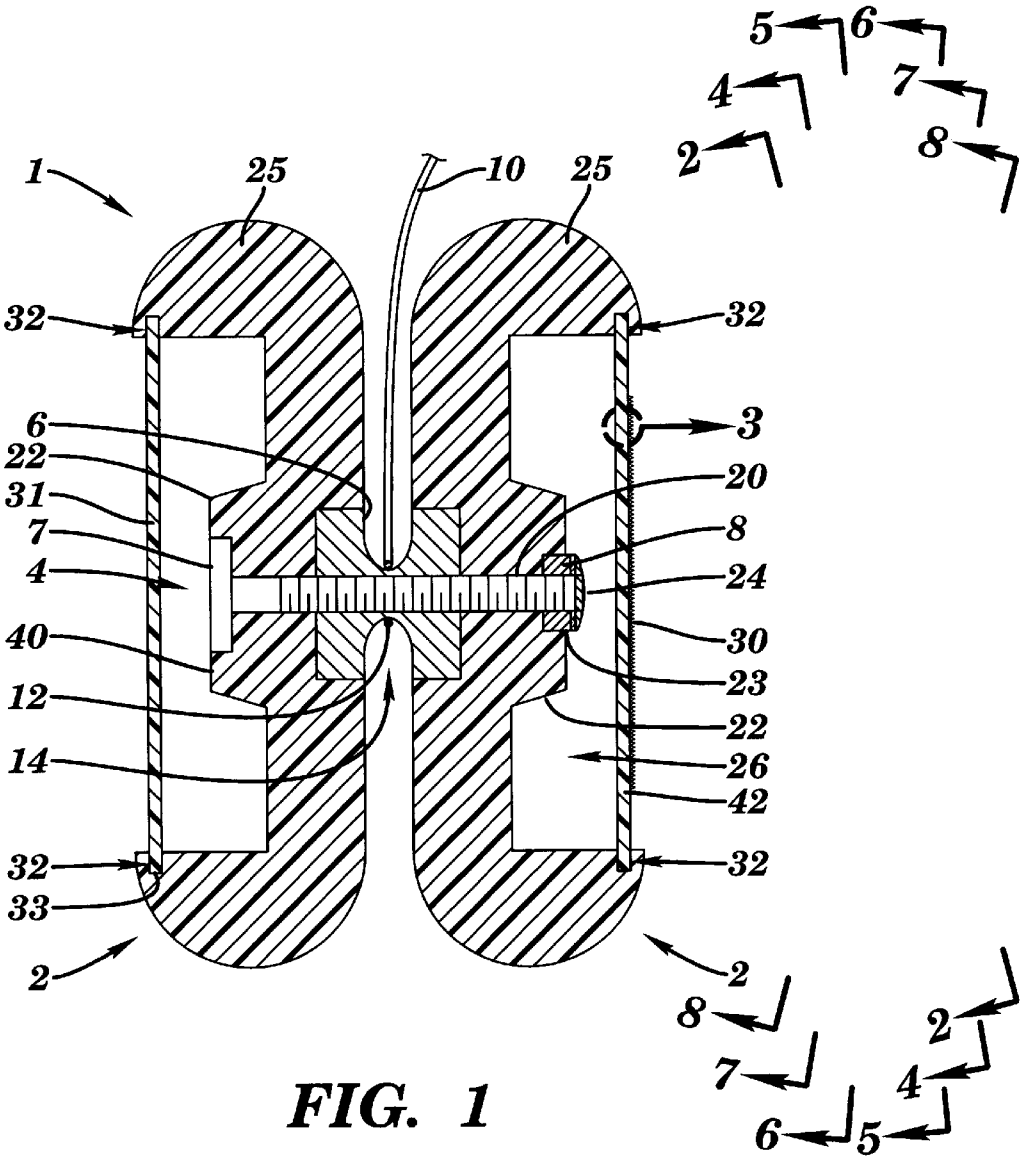
FIG. 1 is a cross-sectional, elevation view of a yo-yo that includes a lenticular side cap having an instruction system in accordance with the invention.

Referring now to the drawings in greater detail, wherein like characters refer to like parts throughout the several figures, there is shown by the numeral 1 a yo-yo in accordance with the invention.

The yo-yo 1 includes first and second disk-shaped side members 2 that are connected together via an axle assembly 4 having an axle block 6. The axle assembly includes a bolt 7 having a hex-shaped head that fits into a complementary recess in the associated side member. The threaded end of the bolt is engaged to a hex-shaped cap nut 8 that fits into a complementary recess in its associated side member. The axle block fits into other complementary recesses in the side members and rotates with said side members.

As shown in FIG. 1, a string-type tether 10 includes a loop portion 12 that encircles, and is thereby anchored to, a center portion 14 of the axle assembly's axle block. The tether's distal portion (not shown) would normally be secured to one of a user's fingers to thereby enable a user to manipulate the yo-yo via its tether 10.

The bolt 7 passes through a central thru-bore 20 and a hub 22 of each side member 2. As noted previously, the outer portion of the hub has a recess 23 designed to inwardly receive, in a snug, non-rotatable manner, either the head of the bolt 7, or the nut 8. The recess is preferably hexagonally-shaped and thereby complementary to the exterior shape of the bolt head and nut. The interlocking of the bolt head or nut into its complementary recess in the associated side member enables a user to disassemble the yo-yo by turning one of the side members 2 relative to the other side member 2. The nut 8 is preferably a cap nut that includes a resilient element 24 to prevent inadvertent loosening of the nut from the bolt.

As known in the art, each side member 2 includes an annular rim portion 25. A large percentage of the side member's weight is concentrated in said rim portion to thereby provide the yo-yo with favorable balance and spin characteristics. The side members are typically made from a rigid, plastic material.

Surrounding the hub 22 of each side member is an annular open area 26. To improve the aerodynamics and aesthetics of the yo-yo, it is desirable to at least partially enclose said area. To accomplish this, a plastic side cap 30 is shown secured to one of the side members 2. A similar side cap 31 is shown secured to the other of the side members. Removable securement of the side caps is achieved using a groove 32 located in the hub-facing surface of each side member. The groove forms a circle and is sized to inwardly receive the outer perimeter of the associated side cap. The groove preferably has a flat bottom surface 33.

Each of the side caps has a diameter equal to, or slightly less than, the diameter of the circle formed by the groove's bottom surface. To insert either side cap into the associated side member, the side cap is slightly deformed until the outer perimeter of the side cap is received within the groove 32. Once the deforming pressure on the side cap is removed, the side cap will return to its original, flat shape and thereby be snugly secured to the side member via the outer edge of the side cap being received within the confines of the groove.

Figure 3:
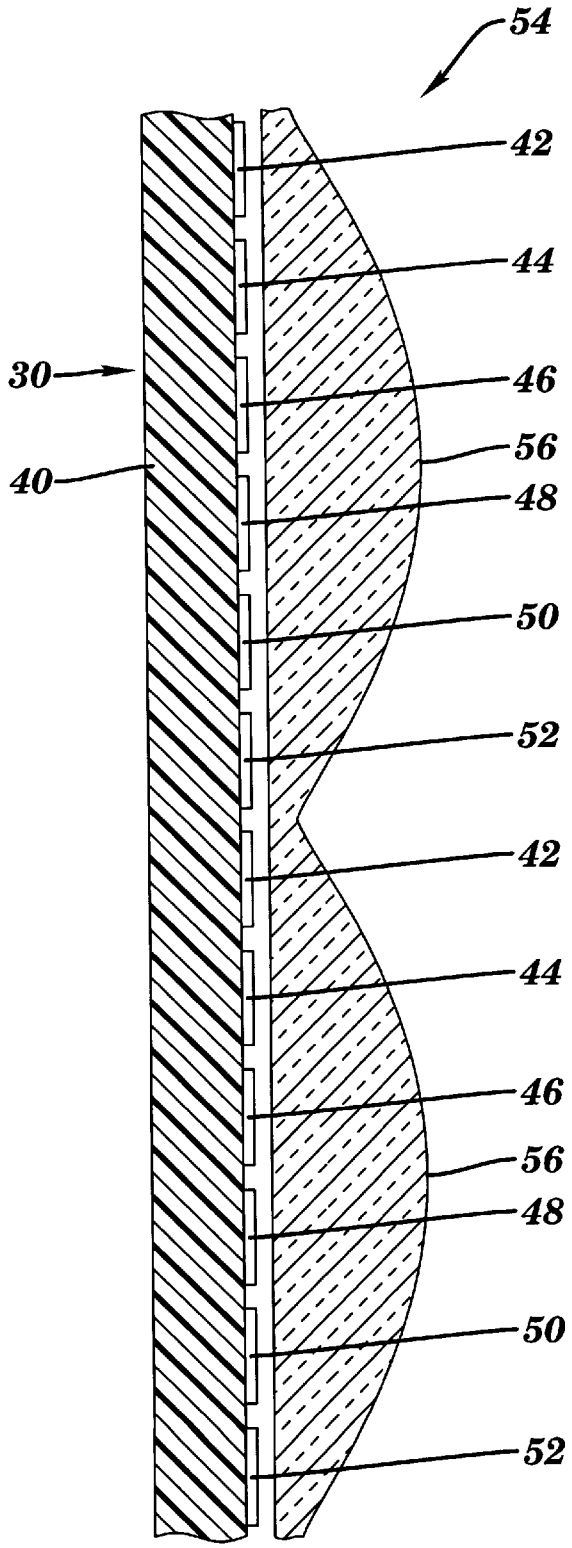
FIG. 3 is a detailed cross-sectional view of a magnified portion of the lenticular side cap shown in FIG. 1.

A portion of side cap 30 is shown magnified, in cross-section, in FIG. 3. It should be noted that side cap 31 can have a size, shape and structure identical to side cap 30. In the preferred embodiment, both of the side caps 30 and 31 are round and preferably have a diameter of approximately 1.75 inches. Each side cap preferably has a thickness of about 0.03 inches.

As can be seen in FIGS. 1 and 3, side cap 30 includes a base portion 40 that is preferably made of a semi-rigid, or flexible, plastic material. In the preferred embodiment, base portion 40 is round, made of a plastic material, and has a thickness of approximately one-sixty-fourth of an inch. Located atop the base portion on the surface that faces away from the yo-yo, are a plurality of thin, elongated strips 42, 44, 46, 48, 50 and 52 of six printed pictures. Each of the strips, to be herein referred to as an image strip, is in the form of a narrow rectangle that has its longitudinal axis extending in a direction into the paper. The rectangle displays a narrow portion of a total image. To better picture the process for forming an image using the image strips, if one were to take a picture that is printed on a piece of paper and then cut the paper into a hundred narrow strips, each strip would be like one of the image strips 42. If one were to place the strips back together in their original orientation, basically putting the paper back into its precut form, the strips 42 would be combined and the original picture would be reassembled. In the invention, all of the strips 42, if placed one next to the other in proper sequence, would form an image or picture 60. All of the strips 44, if they were placed one adjacent the next in the same manner, would form a second, different, but related, image. The other strips would similarly form distinct images if likewise combined. In the view shown in FIG. 3, one should note that the strips associated with any one of the images are located in non-adjacent relation. While the strips are shown located on the surface of the side cap that faces away from the tether, it should be noted that the base portion can be made out of a transparent material and that the strips could then be located on either surface of the base portion, or even within the base portion itself.

Located atop the base portion 40 is a lenticular lens 54 having a plurality of lenticules 56. Each lenticule covers one set of printed strips 42–52 and is made of a transparent material, preferably an optical grade plastic. The lenticules have a hemispherical outer surface and an elongated, rectangular shape. The longitudinal axis of each lenticule is parallel to the longitudinal axis of the printed strips. The image strips, their support structure or base, and the lenticular lens form a multi-image instruction device or system for teaching yo-yo tricks.

Figure 2:
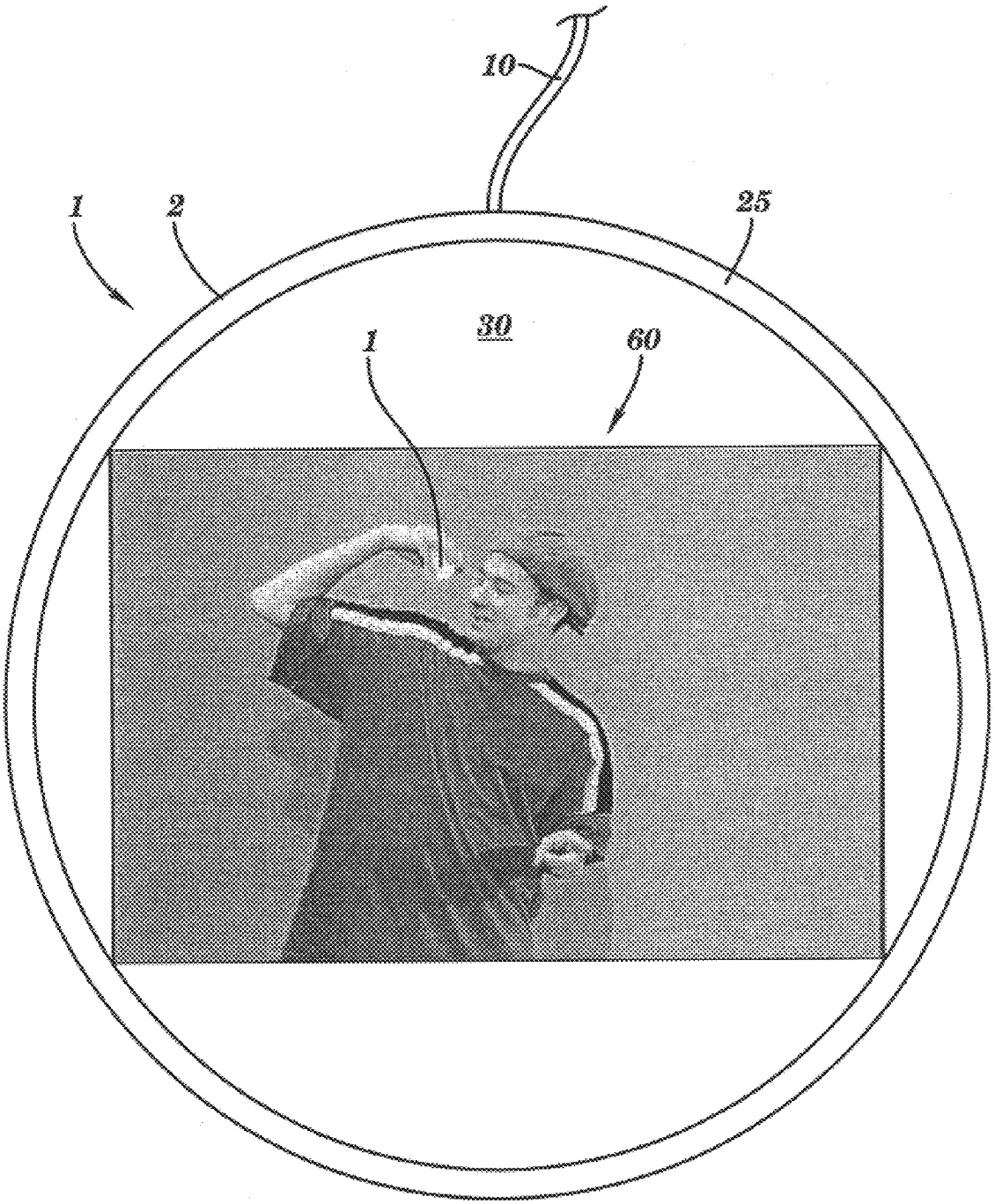
FIG. 2 is a side view of the yo-yo shown in FIG. 1.
Figure 4:
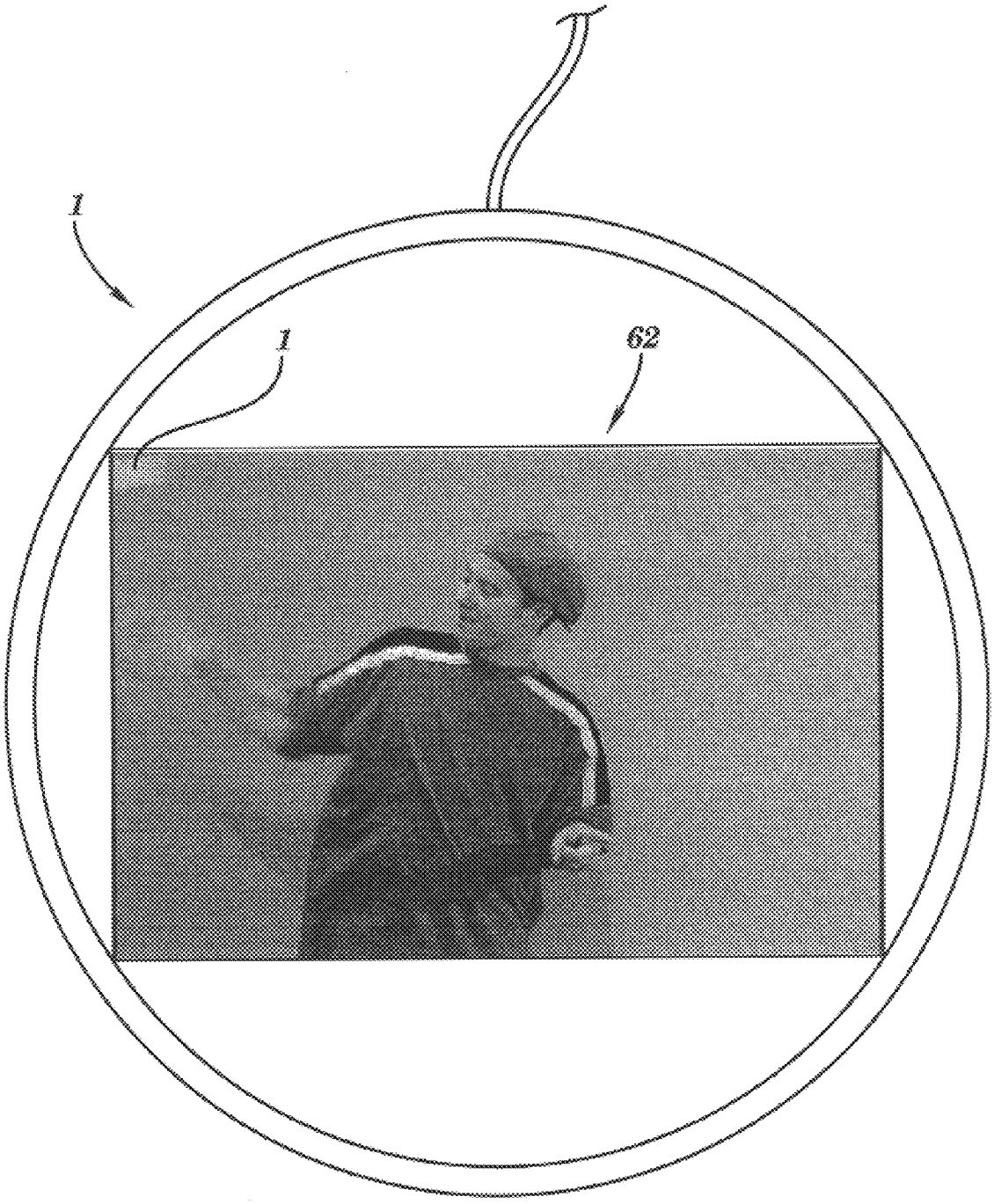
FIG. 4 is a side view of the yo-yo shown in FIG. 1, with the yo-yo slightly tilted from the position shown in FIG. 2.

In the practice of lenticular imaging, each lenticule functions to focus the viewer's vision on a small area of the surface of the base 40. The particular area of focus is dependent on the angle of the lens or lenticule relative to the viewer's eyes. In this manner, each lenticule will focus primarily on a particular one of the strips 42–52, dependent on how the user is orienting the side cap 30 relative to his or her eyes. As a result, when the side cap 30 is oriented in a first position (relative to the viewers eyes), as depicted in FIG. 2, all of the lenticules will focus primarily on the strips numbered 42. As a result, the displayed image combines all of the strips 42 and image 60 is displayed to the user viewing the side cap. When the user slightly reorients the lens to the light and thereby changes the area of focus of the lenticules relative to the user's eyes, the lenticules will then focus primarily on the strips that form a different image. This is shown in FIG. 4 wherein the lenticules are focused primarily on the strips 44 and image 62 is displayed to a user viewing the side cap.

Figure 5:
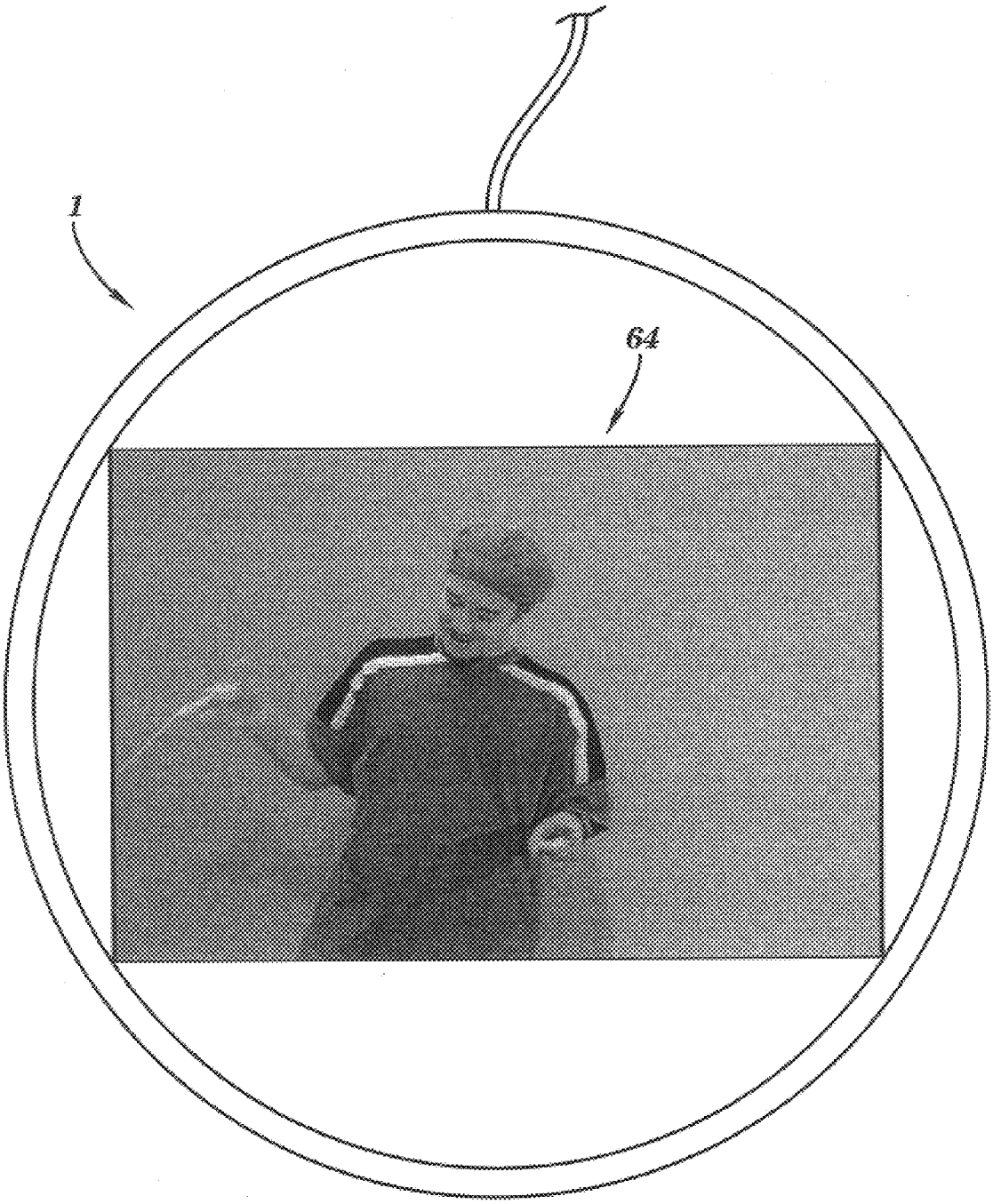
FIG. 5 is a side view of the yo-yo shown in FIG. 1, with the yo-yo further tilted from the position shown in FIG. 4.
Figure 6:
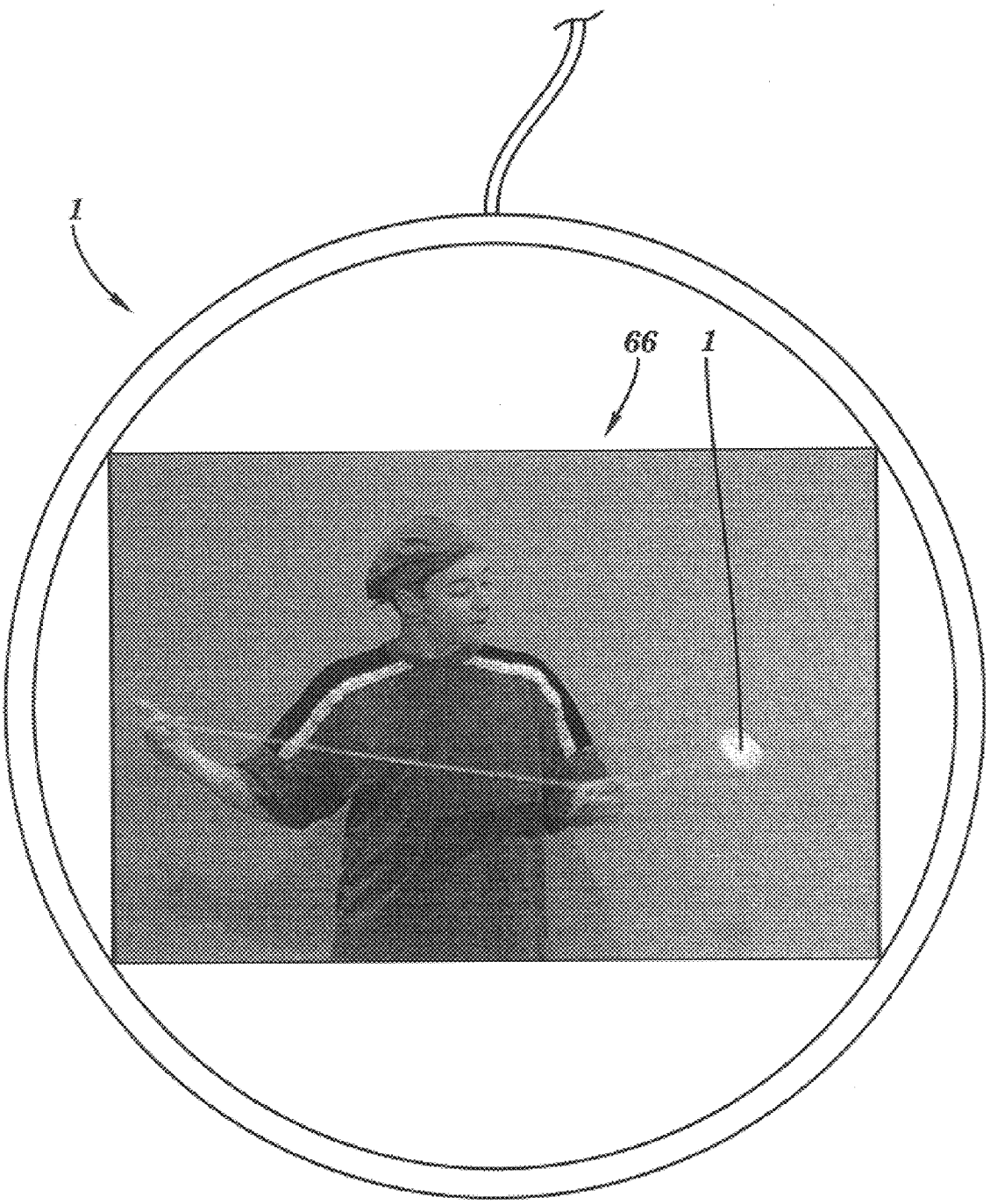
FIG. 6 is a side view of the yo-yo shown in FIG. 1, with the yo-yo further tilted from the position shown in FIG. 5.
Figure 7:
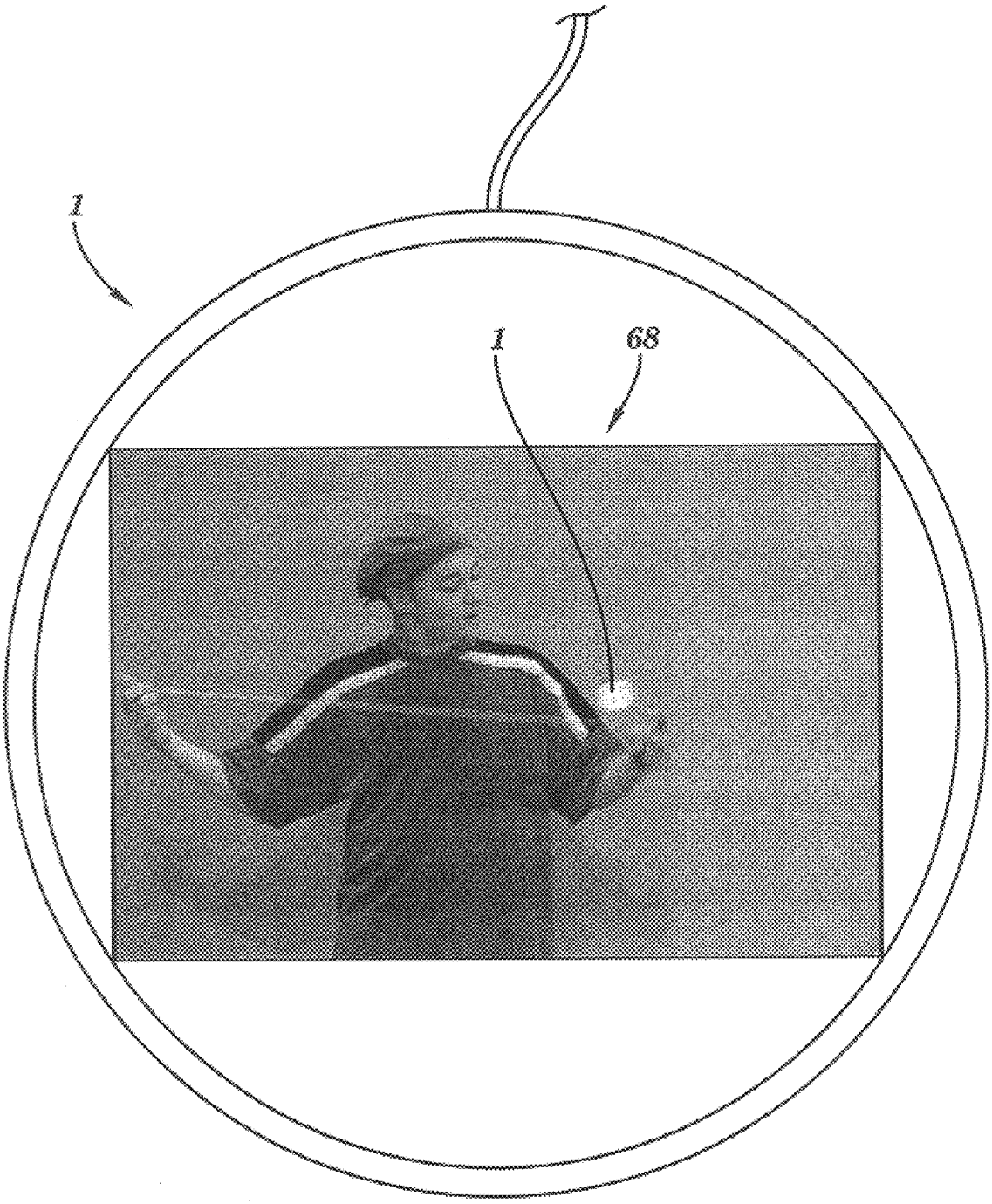
FIG. 7 is a side view of the yo-yo shown in FIG. 1, with the yo-yo further tilted from the position shown in FIG. 6.
Figure 8:
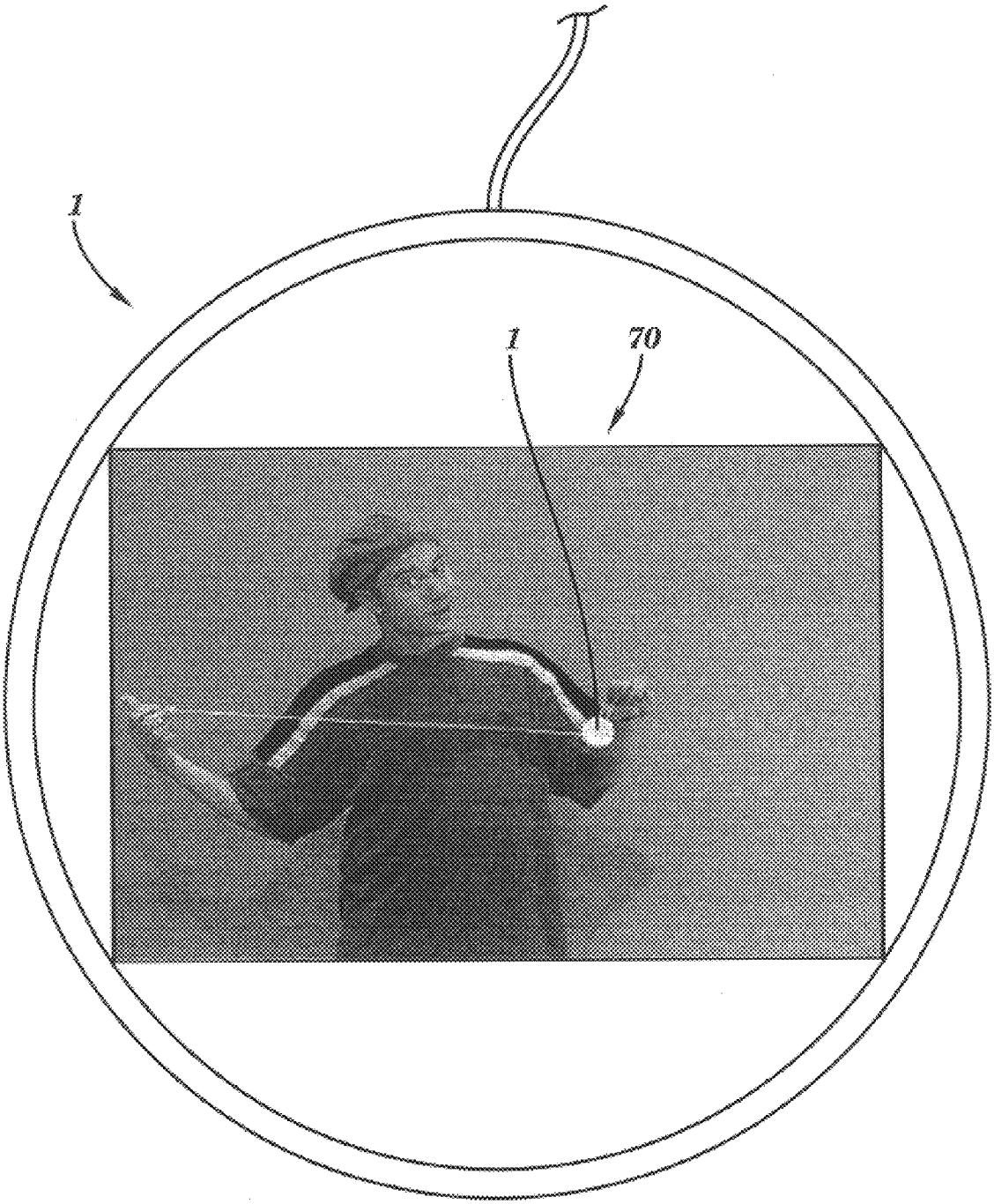
FIG. 8 is a side view of the yo-yo shown in FIG. 1, with the yo-yo further tilted from the position shown in FIG. 7.

In FIG. 2, image 60 shows a person beginning a yo-yo trick, i.e.—accomplishing a first step in the performance of the trick. In FIG. 4, the yo-yo has been re-oriented relative to the viewer so that the lenticular lens is focusing primarily on all of the strips 44, thereby displaying image 62. Image 62 shows the same person shown in FIG. 2, but the person and yo-yo are shown accomplishing the next step required for the performance of the same yo-yo trick as shown in FIG. 2. FIG. 5 shows the same yo-yo, but the yo-yo is now oriented so that the lenticular lens is focusing primarily on all of the strips 46. The resultant displayed image 64 shows the same person performing the third step of the same yo-yo trick as shown in FIGS. 2 and 4. FIGS. 6–8 show the same yo-yo, but the yo-yo is reoriented in each of the figures to focus primarily on strips 48, 50 and 52 respectively. As a result, images 66, 68 and 70 respectively are shown in the figures, thereby providing the viewer with images that show subsequent steps in the performance of the same yo-yo trick as begun in the previously described figures.

While only six different images are shown detailing how a particular yo-yo trick is accomplished, the current state of the art for lenticular imaging allows one to print, and display, as many as thirty-four separate images on a base sheet. Therefore, for complicated tricks, the side cap will preferably include a large number of sequential images. A less complicated trick may be taught using a fewer number of images. It should be noted that as the user reorients the yo-yo while viewing the side cap 30, the different images can be viewed in sequence, or in overlapping sequence, to thereby provide the viewer with an animated rendition of the trick being performed. In some cases, it might be advantageous to provide multiple images of the same step, thereby facilitating a user's ability to freeze the trick at a certain point. In other cases, it may be advantageous to provide a large number of sequential images to thereby capture the maximum amount of action and create a very smooth transition between each image. The resultant animated display of the trick will minimize the jerkiness of the animated display of the trick.

The invention, as described, is shown incorporated into one form of yo-yo. However, the invention is not limited to the yo-yo shown and can be incorporated into other types and styles of yo-yos, such as yo-yos having different types of axles and different designs of side members. It is even possible to modify existing yo-yos to include a lenticular-type of instruction system, as taught herein. This can be accomplished by placing a side cap having a lenticular instruction system in front of, or in place of, an existing side cap. Additionally, since the taught lenticular structure can be incorporated into any suitable structure, it can even be added to yo-yo's that do not have side caps. For example, if a yo-yo did not have side caps but had an exterior surface of sufficient size to enable the placement of strips of images and a lenticular lens atop said strips, the lenticular system could be placed either directly on said surface, or placed on a structure that could be adhered to or otherwise affixed to said surface. Therefore, the lenticular instruction system, as taught herein, can be employed with, or added to almost any prior art yo-yo.

The preferred embodiment of the invention disclosed herein has been discussed for the purpose of familiarizing the reader with the novel aspects of the invention. While the lenticular instruction system is taught for use with a yo-yo, it is within the purview of the invention to employ the system with other devices, whereby a lenticular display is secured to the device and teaches a procedure related to the function, operation or maintenance of the device. Although a preferred embodiment of the invention has been shown and described, many changes, modifications and substitutions may be made by one having ordinary skill in the art without necessarily departing from the spirit and scope of the invention as described in the following claims.

I claim:

1. An improved yo-yo, of the type having first and second side members connected together by a connecting device, wherein a tether is secured at one end about said connecting device, wherein said first side member includes a side cap that has a surface that faces in a direction away from said tether, the improvement comprising:

a multi-image instruction device incorporated into said side cap, wherein the instruction device is visible from an area exterior to the yo-yo; and wherein the multi-image instruction device comprises an image base having a plurality of different images located on a surface thereof, wherein a plurality of said images show different steps in the performance of a predetermined yo-yo trick, wherein a lenticular lens having a plurality of lenticules is located adjacent said image base, and wherein said lenticules enable a user to focus on a different one of said images dependent on how the yo-yo is oriented relative to the user's eyes.

2. The yo-yo of claim 1 wherein the image base is made of a plastic material.

3. The yo-yo of claim 1 wherein each image is formed from a plurality of image strips, wherein a first plurality of said strips are located in non-adjacent positions on said image base and make up a first image of said plurality of images, and wherein a second plurality of image strips are located in non-adjacent positions on said image base and make up a second image of said plurality of images, and wherein when a user is holding the yo-yo in a first position, the first image is seen by the user through the lenticules, and wherein when the yo-yo is held in a second position that is different from said first position, the second image is seen by the user through the lenticules.

4. The yo-yo of claim 1 wherein the side cap has outer dimensions substantially identical to outer dimensions of the image base.

5. The yo-yo of claim 1 wherein the side cap is in the form of a round disk.

6. A yo-yo comprising:

first and second side members connected together by a connecting device;

a tether secured at one end about said connecting device;

a multi-image instruction device incorporated into one of said side members, wherein said instruction device is visible from an area exterior to the yo-yo; and wherein the multi-image instruction device comprises an image base that supports a plurality of strips of different images, wherein a plurality of said images show different steps in the performance of a predetermined yo-yo trick, wherein a lenticular lens having a plurality of lenticules is located adjacent said image base, and wherein said lenticules enable a user to focus on said strips of images in a manner wherein a different one of said images is viewable by the user dependent on how the yo-yo is oriented relative to the user's eyes.

7. A method for teaching a person how to perform a yo-yo trick, said method comprising:

holding in one hand a yo-yo having a lenticular instruction system incorporated into an exterior-viewable portion of said yo-yo, wherein said instruction system includes a plurality of related images that show how a yo-yo should be manipulated in order to perform a predetermined yo-yo trick;

holding the yo-yo in a first position whereby a first image of said plurality of images of said lenticular instruction system is viewable by said user, wherein said image shows a first step for performing said trick;

re-orienting the yo-yo to a second position whereby a second image of said plurality of images of said lenticular instruction system is viewable by said user, wherein said second image shows a latter step in the performance of said trick; and continuing to re-orient the yo-yo until all of the images viewable via the lenticular instruction system have been displayed to the user.

* * * * *